US005736813A

United States Patent [19]

Foust et al.

[11] Patent Number: 5,736,813

[45] Date of Patent: Apr. 7, 1998

[54] PH CONTROL OF LEACHABLE MERCURY IN FLUORESCENT LAMPS

[75] Inventors: Donald Franklin Foust, Scotia; Deborah Ann Haitko; David Key Dietrich, both of Schenectady, all of N.Y.

[73] Assignee: General Electric Company, Schenectady, N.Y.

[21] Appl. No.: 764,702

[22] Filed: Nov. 29, 1996

[51] Int. Cl.[6] ..... H01J 61/00

[52] U.S. Cl. ..... 313/490; 313/565; 313/637; 313/639

[58] Field of Search ..... 313/484, 490, 313/565, 637, 638, 639, 640, 641, 642

[56] References Cited

U.S. PATENT DOCUMENTS

| | | | |
|---|---|---|---|
| 4,806,824 | 2/1989 | Paynter et al. | 313/487 |
| 5,198,722 | 3/1993 | Brabham et al. | 313/623 |
| 5,229,686 | 7/1993 | Fowler et al. | 313/565 |
| 5,229,687 | 7/1993 | Fowler et al. | 313/565 |

*Primary Examiner*—Sandra L. O'Shea
*Assistant Examiner*—Vip Patel
*Attorney, Agent, or Firm*—James Magee, Jr.

[57] ABSTRACT

The formation of leachable mercury upon disposal or during TCLP testing of mercury vapor discharge lamps is substantially prevented by incorporation of a pH control agent in the lamp structure or in the test solution to provide a pH of about 5.5 to about 6.5.

11 Claims, 2 Drawing Sheets

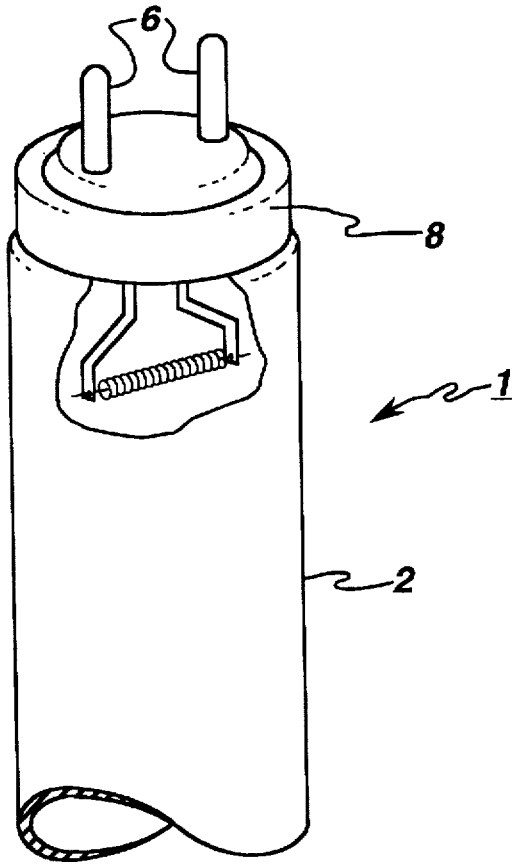
fig. 1
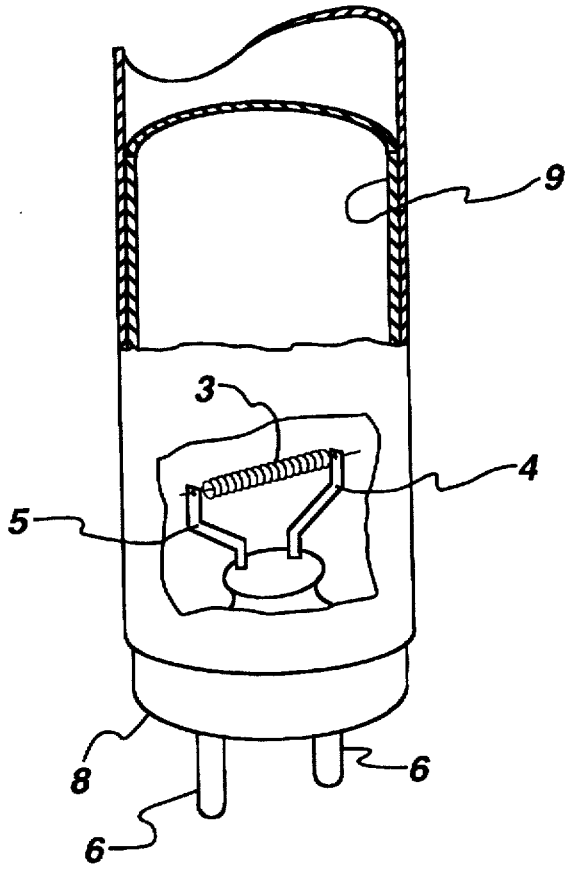

PH CONTROL OF LEACHABLE MERCURY IN FLUORESCENT LAMPS

This invention is directed to mercury vapor arc discharge lamps in which the arc discharge takes place in mercury vapor, including conventional phosphor fluorescent lamps and more particularly to the use of pH control agents to reduce or prevent mercury pollution of landfills and groundwaters upon disposal of such lamps and during testing for leaching of toxic materials from such lamps and to compositions of matter useful in preventing the formation of leachable mercury in disposal and testing procedures. The lamps provided herein are characterized by reduced solubilization and leaching of mercury when the lamp is pulverized for testing or upon disposal.

BACKGROUND OF THE INVENTION

Low pressure mercury arc discharge lamps are standard lighting means which include electrodes sealed in a glass envelope, the interior of which may be coated with a phosphor. The lamp also contains a small amount of mercury and an inert gas at low pressure, e.g., about 1 to 5 torr. The term lamp, as used herein, means the complete unit including the glass envelope and the end pieces and plugs for mounting in a lamp fixture, and wires which connect the internal components of the envelope with the end pieces.

During manufacture of fluorescent or low pressure mercury arc lamps an amount of elemental mercury ($Hg^0$) is sealed in the lamp envelope. Most of the mercury adheres to the phosphor coating, a small amount being in the vapor phase.

During operation, alkali metal carbonates from the electrodes decompose and form free oxygen in the lamp. The oxygen, in the presence of hydrogen ions and metals, can react with a portion of the mercury to form soluble mercury oxides, e.g., HgO. Soluble mercury oxides are leachable from land fills and other disposal facilities. Soluble mercury oxides or other oxidized forms of mercury formed in the course of the test are detrimental to the accuracy and reliability of the standard test for determination of the leachability of toxic materials from lamp waste. This test is generally referred to as the Toxicity Characteristic Leaching Procedure or TCLP test.

There is concern about the environmental impact of soluble mercury compounds which can leach into ground water sources, aquifers, rivers, streams, and the like.

SUMMARY OF THE INVENTION

Ferric and cuprous ions form soluble compounds which are capable of oxidizing elemental mercury to the monovalent, mercurous, form which is soluble in an acidic aqueous environment and therefore leachable. The formation of ferric and cuprous compounds depend on exposure to and reaction with oxygen. Alkaline pH control agents, either organic or inorganic, incorporated in the lamp prevent formation of ferric and cuprous compounds, in the presence of water or moisture, by oxidation of iron and copper from lamp components, thereby greatly reducing or preventing the formation of leachable mercurous and mercuric compounds of mercury. The term "alkaline pH control agents" includes bases which raise the pH of an aqueous composition and buffer compositions which raise and maintain the pH of aqueous compositions.

The invention provides a mercury vapor discharge lamp comprising an envelope of light transmitting glass which contains, an inert gas and an amount of elemental mercury, a pair of electrodes for establishing an arc discharge, and an effective amount of a pH control agent.

The lamp further comprises at least one base or end cap which defines a cavity having an inner surface, and which is secured to the lamp envelope by a basing cement, the pH control agent being disposed within said cavity. Generally fluorescent tube lamps have a pair of end caps.

The invention further provides a composition which can be included in the lamp structure for the purpose of controlling pH at a point which minimizes or prevents formation of soluble mercury compounds, thereby reducing or preventing formation of water soluble leachable mercury compounds in landfills or TCLP test samples.

The pH control agent can be admixed with the basing cement securing the end caps in place on the glass lamp envelope.

In a preferred embodiment of the invention, the mercury vapor discharge lamp is provided with the pH control agent carried on the inner surface of the cavity within the cavity formed by at least one of the end cap by means of an inert water soluble adhesive binder.

BRIEF DESCRIPTION OF THE DRAWINGS

FIG. 1 is a partially broken away section of a low pressure mercury fluorescent lamp 1 comprising a glass envelope 2 having a phosphor coating 9 on the inner surface of the glass. Connector pins 6 are in electrical contact with leads 4 and 5 and also with electrodes 3.

DESCRIPTION OF THE INVENTION

Figure 2:
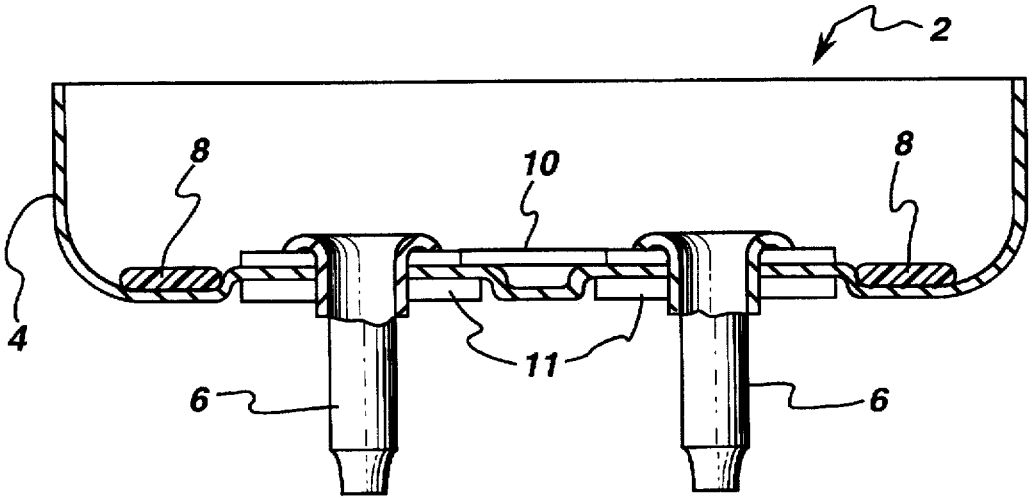
In FIGS. 2 and 3 the end caps are shown as 2, corresponding to numeral 8 of FIG. 1. The end cap is provided with connector pins 6 and pH control agent 8 deposited in the cavity of end cap 2.
Figure 3:
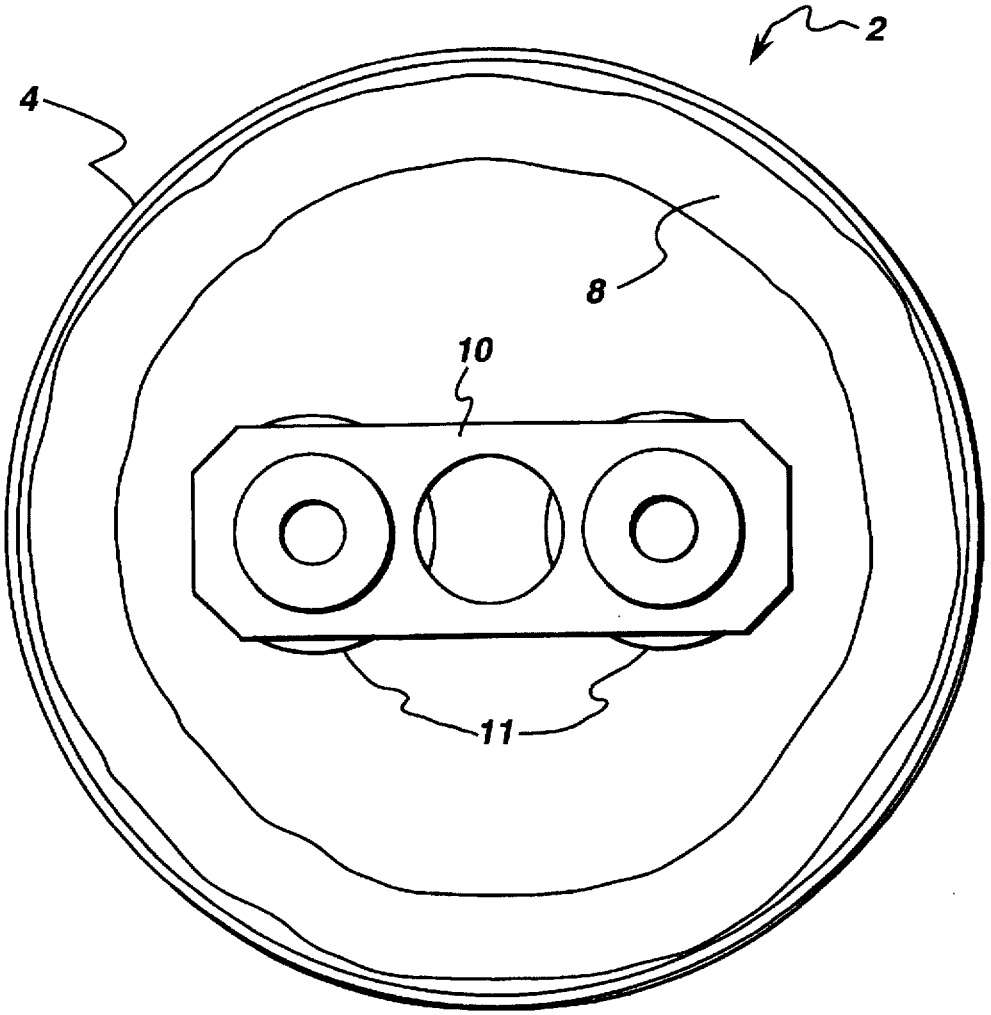

The incorporation of pH control agents in a lamp structure or to the TCLP test solution prevents oxidation of iron and copper metal components to a form which is both soluble and capable of oxidizing elemental mercury to a soluble form of mercury oxide. Accordingly the formation and dissolution of soluble ferric and cuprous compounds from the lamp components is diminished or prevented resulting in reduction or prevention of leachable mercury compounds.

The formation of leachable mercury when fluorescent lamps are broken and exposed to landfill conditions can be prevented or minimized by preventing oxidation of certain components of the lamp. Certain metal components of fluorescent lamps particularly iron lead wires, copper coated leads, and any brass components generate ferric ($Fe^{+3}$) and cuprous ($Cu^{+1}$) ions when exposed to moisture, oxygen, and acidity.

In order to address the growing concern that excessive amounts of mercury from disposal of fluorescent lamps might leach into surface and subsurface bodies of water, the Environmental Protection Agency has established a maximum concentration level for mercury at 0.2 milligrams of leachable mercury per liter. This is generally determined by the standard analysis known as the Toxicity Characteristic Leaching Procedure (TCLP), a well known test procedure.

In carrying of the TCLP test, the lamps are pulverized to form lamp waste material similar to that which would result from lamp disposal in landfills or other disposal locations. The ambient conditions in such locations may be such as to promote formation of leachable mercury just as the TCLP test conditions themselves tend to allow for formation of leachable mercury in amounts greater than the established limit of 0.2 milligrams per liter.

It has been found that elemental mercury added to mercury-free pulverized lamp materials prepared for the TCLP test is converted to leachable mercury in the course of the test. If elemental mercury alone or in combination with various glass, phosphor, or non-metal lamp components is tested, little or essentially no leachable mercury is found. When elemental mercury is tested in combination with metal lamp components such as copper or iron, lead wires, pins, or other metal hardware, the mercury is transformed into a leachable form.

It was determined by controlled experimentation that both ferric iron (trivalent) and cuprous (monovalent) copper are generated under the TCLP test conditions when carried out in the presence of oxygen and that these ionic species are able to oxidized elemental mercury to soluble mercury compounds which are measured as leachable mercury.

Corrosion, i.e., oxidation, of metals from the metallic state requires the presence of hydrogen ions, oxygen, and a solvent such as water, conditions that exist in the TCLP test and in many landfill situations. Accordingly, it has been found that the formation of leachable mercury can be controlled or prevented by controlling or excluding exposure of the iron and copper-containing metal lamp components to acidity and oxygen. This can be done by the use of pH controlled test and disposal conditions.

Inorganic pH control agents incorporated into fluorescent lamps during manufacture become operative in the course of preparing lamps for the TCLP test or upon destruction of the lamp during disposal in an aqueous environment having sufficient acidity to support formation of ferric and cuprous ions. The presence of such a pH control agent will make the TCLP test more accurate and reliable by preventing spurious formation of soluble mercury in the test and will also reduce formation of soluble mercury compounds when the lamps are disposed of.

Suitable pH control agents include any materials, compounds, or systems which prevent or reduce the formation of ferric and cuprous ions in the mercury-containing environment by controlling the ambient pH at about 5.5 to about 6.5. Water soluble carbonates, hydrogencarbonates, hydroxides, and oxides are useful for providing a pH from about 5.5 to about 6.5, preferably about 6. In general increasing the pH above 6.5 provides no further protection against formation of soluble mercury.

Illustrative pH control agents include sodium carbonate, potassium carbonate, calcium hydroxide, sodium hydroxide, magnesium hydroxide, potassium hydroxide sodium bicarbonate, magnesium oxide, calcium oxide, and the like. Calcium oxide and calcium hydroxide are preferred compositions for use in this invention.

The principles and practice of this invention will be more fully understood when considered in view of the following examples.

All TCLP test data was obtained by the test procedure prescribed on pages 26987–26998 volume 55, number 126 of the Jun. 29, 1990 issue of the Federal Register.

Briefly, lamps being tested are pulverized into particulate form having the prescribed particle size which is capable of passing through ⅜ inch sieve. The test material is then extracted with a sodium acetate-acetic acid buffer at a pH of about 4.93.

To prevent false formation of leachable during the test and unwanted formation of leachable mercury upon disposal of mercury vapor discharge lamps and to improve the reliability of the TCLP test an effective amount of a pH control agent is incorporated in the lamp structure, for example within the glass envelope exterior to the plasma discharge or in an end-cap, or in the base of the lamp. An effective amount of the pH control agent is that amount which will substantially prevent formation of ferric and cupric compounds which can oxidize elemental mercury to a soluble form. In general, an effective amount of the pH control agent will be enough for the TCLP test results to show the presence of less than about 0.2 parts per million of leachable mercury resulting from the iron and copper content of the lamp.

The effect of oxygen at a common pH on formation of soluble mercury compounds is illustrated by the data in Table 1, below. Carrying out the TCLP test at pH about 4.9 in the presence of air generates about 1 part per million of copper and about 0.3 parts per million of soluble iron. The amount of soluble mercury formed under these conditions exceeds the regulatory limit of 0.2 parts per million. Increasing the exposure to oxygen increases the amount of soluble copper and soluble mercury formed. Decreasing exposure to oxygen decreases the formation of soluble copper and soluble mercury.

TABLE 1

| Gas Type | Soluble Cu (ppm) | Soluble Hg (ppm) |
|---|---|---|
| Air | 1.07 | 0.777 |
| Argon | 0.06 | <0.050 |
| Oxygen | 3.04 | 1.030 |

When the amount of oxygen is varied by increasing the volume of the head space in the TCLP test jar, the effect of both soluble iron and copper on the formation of soluble mercury is evident from the data in Table 2, below. As the head space volume increases, the amount of soluble mercury increases in response to the formation of increasing amounts of soluble copper and iron.

TABLE 2

| | Head Space (mL) | Soluble Mercury (ppb) | Soluble Iron (ppm) | Soluble Copper (ppm) |
|---|---|---|---|---|
| 0 | 0.0000 | 210 | 3.62 | 0.35 |
| 1 | 140 | 214 | 4.63 | 0.40 |
| 2 | 205 | 203 | 5.04 | 0.63 |
| 3 | 360 | 250 | 5.22 | 0.43 |
| 4 | 494 | 311 | 5.22 | 0.51 |
| 5 | 763 | 525 | 6.13 | 1.04 |
| 6 | 1013 | 458 | 5.80 | 1.02 |
| 7 | 1508 | 583 | 8.12 | 1.13 |

When pH is controlled by adjustment of the amounts of acid and base in the test solution, the formation of soluble mercury is decreased as shown in Table 3.

TABLE 3

Effect of pH Upon Soluble Metals

| Initial pH of Extractant | Final pH of Extractant | ORP* | [Cu] in ppm | [Fe] in ppm | [Hg] in ppm |
|---|---|---|---|---|---|
| 4.93 | 5.27 | 278 | 1.03 | 3.93 | 1.800 |
| 7.0 | 9.07 | 130 | <0.07 | <0.30 | <0.050 |
| 6.0 | 8.17 | 67 | <0.07 | <0.30 | <0.050 |

*ORP = Oxidation Reduction Potential

Reactive metals such as copper and iron corrode under acidic conditions. Increasing the pH to more neutral or alkaline conditions reduces the corrosion tendency. As shown in Table 4, below, under neutral or basic conditions the concentration of iron and copper ions is reduced as is the concentration of leachable mercury. Basic additives can be used to control the metal dissolution chemistry responsible for the formation of leachable mercury.

TABLE 4

Effect of Additives On Leachable Mercury In Fluorescent Lamps

| Additive | Hg Dose (mg/lamp) | Amt. of Additive (gm/lamp) | ORP* | Final pH | Leachable Hg (ppb) |
|---|---|---|---|---|---|
| none | 21.2 | — | — | — | 745 |
| $Na_2CO_3$ | 20.2 | 14 | 218 | 7.26 | 82 |
| $Ca(OH)_2$ | 19.8 | 6.6 | −3 | 11.06 | <50 |
| $Ca(OH)_2$ | 20.0 | 2.0 | 334 | 5.36 | 312 |
| $Ca(OH)_2$ | 20.0 | 1.0 | 304 | 5.24 | 665 |

*ORP = Oxidation Reduction Potential

Table 4 shows examples of a pH control agent that have been added to the TCLP extraction to study the effect upon leachable mercury. The first entry is a control showing the amount of leachable mercury generated when the pulverized lamp is dosed with about 20 mg of elemental mercury. The leachable mercury generated in that case is 745 ppb in the absence of any pH control agent. The pH control agent can be incorporated in the lamp by encapsulation of the material in a glass capsule that can be placed either in the base of the lamp between the aluminum cap and flare of leaded glass, or placed within the positive column of the lamp. Since the pH control agent is enclosed in a glass capsule it could be present in the inside or positive column of the lamp without affecting lamp function.

TABLE 5

Effect of pH on Solubility of Mercury

| Mercury Dose (mg/lamp) | Concentration of Acetic Acid (g/L) | Concentration of Sodium Hydroxide (g/L) | Initial pH | Final pH | Soluble Mercury (ppb) | Soluble Iron (ppm) |
|---|---|---|---|---|---|---|
| 10 | 12 | 3.4 | 4.94 | 5.05 | 131 | 8.5 |
| 10 | 6 | 1.7 | 4.93 | 5.12 | 111 | 2.8 |
| 10 | 3 | 0.85 | 4.97 | 5.33 | 68 | 1.0 |
| 10 | 1.5 | 0.42 | 4.94 | 5.77 | 29 | <0.1 |

Table 5 shows the effect on soluble mercury of pH adjustment by use of varying amounts of acetic acid and sodium hydroxide in an aqueous composition representative of the TCLP test composition. As the pH increases the amount of soluble mercury is reduced to acceptable levels. Control of the pH can also be achieved by adding the base, such as sodium hydroxide, to the TCLP acetic acid acetate buffer.

The pH control agent material can also be incorporated in the basing cement of the lamp that holds the aluminum cap to the leaded glass portion of the end of the lamp. The basing cement generally comprises about 80 weight % marble flour (limestone-CaO), and the balance shellac a phenolic resin binder, a solvent for blending, and a dye used to color the cement. The cement is dispensed through a feeder into the base and heated to cure once assembled with the lamp. The curing drives off the solvent and solidifies the cement. The pH control agent is blended with the cement components and incorporated into a lamp manually or by automated manufacturing equipment. The pH control agent material is released only when the lamp is destroyed or crushed in preparation for TCLP testing. In this method the active pH control agent is always exterior to the positive column of the lamp.

Another method for incorporating the active pH control agent material in the lamp structure is to admix it with an inert water soluble adhesive carrier or binder. Gums and gelatins have been used as such adhesives and binders. The nature of the gums and gelatins is that they adhere to surfaces when heated. The composition containing the pH control material can be placed on the inner surface of the aluminum end cap as a ring or discrete button. When the lamp is crushed and exposed to an aqueous environment or placed in the TCLP solution, the water soluble binder allows the pH control agent to be released quickly.

What is claimed is:

1. A low pressure mercury discharge lamp comprising an envelope of light transmitting glass, an inert gas, electrodes, elemental mercury, at least one end piece, wires which connect the end pieces to the electrodes, and an amount of about 5–15 grams pH control agent sufficient to substantially prevent formation of ferric and cupric compounds which oxidize elemental mercury to a soluble form.

2. The mercury vapor discharge lamp of claim 1 wherein the pH control agent is sodium carbonate, potassium carbonate, calcium hydroxide, sodium hydroxide, magnesium hydroxide, potassium hydroxide sodium bicarbonate, magnesium oxide or, calcium oxide.

3. The mercury vapor discharge lamp of claim 1 wherein the amount of pH control agent is calcium oxide or calcium hydroxide in an amount sufficient to maintain the pH from about 5.5 to about 6.5.

4. A mercury vapor discharge lamp comprising an envelope of light transmitting glass which contains an inert gas and elemental mercury, a pair of electrodes for establishing an arc discharge and an amount of about 5–15 grams pH control agent sufficient to substantially prevent formation of cupric and ferric compounds.

5. A lamp according to claim 4 in which the pH control agent is sodium carbonate, potassium carbonate, calcium hydroxide, sodium hydroxide, magnesium hydroxide, potassium hydroxide sodium bicarbonate, magnesium oxide or, calcium oxide present in an amount sufficient to provide a pH of about 5.5 to about 6.5.

6. The lamp according to claim 4 in which the pH control agent is sodium carbonate, and calcium hydroxide present in an amount of about 5 to 15 grams.

7. The mercury vapor discharge lamp according to claim 6 wherein the pH control agent is carried on the inner surface of the cavity by means of an inert water soluble binder.

8. The lamp according to claim 4 further comprising at least one base end cap which defines a cavity having an inner surface, and which is secured to the lamp envelope by a basing cement, the pH control agent being disposed within said cavity.

9. The lamp according to claim 8 in which the pH control agent is admixed with the basing cement.

10. A method for preventing the formation of leachable mercury compounds in mercury vapor discharge lamps which comprises incorporation into the lamp structure of an amount of about 5–15 grams pH control agent.

11. A method according to claim 10 in which the pH control agent is sodium carbonate, potassium carbonate, calcium hydroxide, sodium hydroxide, magnesium hydroxide, potassium hydroxide sodium bicarbonate, magnesium oxide or, calcium oxide present in an amount sufficient to provide a pH of about 5.5 to about 6.5.

* * * * *